US009197005B2

(12) United States Patent
Zaurrini

(10) Patent No.: US 9,197,005 B2
(45) Date of Patent: Nov. 24, 2015

(54) WATERPROOF COVER FOR AN ELECTRICAL PLUG

(75) Inventor: Pasquale Peter Zaurrini, Greystanes (AU)

(73) Assignee: Zap Cap IP Pty Ltd, Greystanes, New South Wales (AU)

( * ) Notice: Subject to any disclaimer, the term of this patent is extended or adjusted under 35 U.S.C. 154(b) by 28 days.

(21) Appl. No.: 14/117,523

(22) PCT Filed: Jun. 8, 2012

(86) PCT No.: PCT/AU2012/000666

§ 371 (c)(1),
(2), (4) Date: Mar. 19, 2014

(87) PCT Pub. No.: WO2012/167326

PCT Pub. Date: Dec. 13, 2012

(65) Prior Publication Data

US 2014/0235119 A1 Aug. 21, 2014

(30) Foreign Application Priority Data

Jun. 9, 2011 (AU) ..... 2011902279

(51) Int. Cl.
*H01R 13/52* (2006.01)
*H01R 13/639* (2006.01)

(52) U.S. Cl.
CPC ..... *H01R 13/5213* (2013.01); *H01R 13/5221* (2013.01); *H01R 13/6392* (2013.01)

(58) Field of Classification Search
CPC ..... H01R 13/5221; H01R 13/6392
USPC ..... 439/367, 369, 521
See application file for complete search history.

(56) References Cited

U.S. PATENT DOCUMENTS

| | | | | |
|---|---|---|---|---|
| 4,214,802 | A | 7/1980 | Otani et al. | |
| 4,724,281 | A | 2/1988 | Nix et al. | |
| 5,306,176 | A | 4/1994 | Coffey | |
| 5,382,756 | A * | 1/1995 | Dagan | 174/92 |
| 5,551,888 | A * | 9/1996 | Rhodes, Sr. | 439/369 |
| 5,913,692 | A * | 6/1999 | Targett | 439/369 |

(Continued)

FOREIGN PATENT DOCUMENTS

AU 2004202503 5/2005

OTHER PUBLICATIONS

Examination Report for NZ 617829, issued Aug. 8, 2014.

(Continued)

*Primary Examiner* — Tho D Ta
(74) *Attorney, Agent, or Firm* — Dority & Manning, P.A.

(57) ABSTRACT

A waterproof cover (10) to enclose a plug assembly (11) of an electrical lead. The cover (10) including a first and a second hollow cover body (17, 18). The bodies (17, 18) being pivotally attached for angular relative movement between an open position and a closed position. The bodies (17, 18) in the closed position providing a chamber (9) to receive the plug assembly (11). The bodies (17, 18) having a longitudinal axis and each with opposite longitudinal end walls. Each end wall (22) being provided with a recess. The recesses of adjacent end walls (22) providing an aperture through which an electrical lead (12, 13) is to extend to an associated male or female plug portion (13, 15). A seal (25) extends between the body portions (17, 18) to completely surround the chamber (9) so that in the closed position the body portions sealingly close the chamber (9) to provide a water proof seal.

12 Claims, 13 Drawing Sheets

(56) References Cited

U.S. PATENT DOCUMENTS

| | | | | |
|---|---|---|---|---|
| 6,099,340 | A | 8/2000 | Florentine | |
| 6,250,946 | B1 * | 6/2001 | Tardy | 439/367 |
| 6,551,135 | B2 * | 4/2003 | Stekelenburg | 439/575 |
| 7,285,725 | B1 * | 10/2007 | Saman | 174/84 R |
| 7,431,611 | B2 * | 10/2008 | King et al. | 439/521 |
| 7,550,672 | B2 * | 6/2009 | Chadbourne et al. | 174/92 |
| 7,686,661 | B2 * | 3/2010 | Shrum et al. | 439/781 |
| 8,016,607 | B2 * | 9/2011 | Brown, II | 439/353 |
| 8,408,929 | B2 * | 4/2013 | Solon | 439/301 |
| 2004/0219820 | A1 * | 11/2004 | Sokol et al. | 439/369 |

OTHER PUBLICATIONS

International Search Report for PCT/AU2012/000666, Aug. 2012.
Supplementary EP Search Report for EP 12797185, Dated Nov. 14, 2014.

* cited by examiner

WATERPROOF COVER FOR AN ELECTRICAL PLUG

CROSS REFERENCE TO RELATED APPLICATIONS

This application is the U.S. National Stage entry of International Application Number PCT/AU2012/000666 filed under the Patent Cooperation Treaty having a filing date of Jun. 8, 2012, which claims priority to Australian Provisional Patent Application Number 2011902279 having a filing date of Jun. 9, 2011, all of which are hereby incorporated by reference herein in their entirety for all purposes.

TECHNICAL FIELD

The present invention relates to waterproof covers to seal and enclose electrical wiring and in particular consisting of a male plug portion and a female plug portion.

BACKGROUND ART

Electrical leads terminate at one end with a male plug portion that can be connected to a power supply. The other end of the lead terminates with a female plug portion that is adapted to engage the male plug portion of a further lead, an appliance, tool, some piece of an electrical apparatus or the like. Plug assemblies (where male and female plug portions are connected) are frequently exposed to the environment. This is of particular concern where a lead is being employed in a wet area and the plug assembly is exposed to the weather.

A further problem in respect of the abovementioned plug assemblies is that the male and female plug portions can become disconnected with the result that the appliance, tool or other electrical apparatus is rendered inactive.

OBJECT OF INVENTION

It is the object of the present invention to overcome or substantially ameliorate at least one of the above disadvantages or to provide a useful alternative.

SUMMARY OF INVENTION

There is disclosed herein a waterproof cover adapted to enclose a plug assembly of an electrical lead, said cover including:

a first hollow cover body and a second hollow cover body, the first and second bodies being pivotally attached together for angular relative movement between an open position and a closed position, the bodies in the closed position providing a chamber to receive the plug assembly, the bodies defining a longitudinal axis and having longitudinally spaced apart oppositely located end walls;

each said end wall having a recess, the recesses of adjacent end walls defining an aperture through which an electrical lead is to extend to an associated male or female plug portions to be located within said chamber in use; said cover including:

a seal operatively associated with said body portions to surround said chamber so that in the closed position the body portions seal said chamber to provide a water proof seal to said cover, the seal frictionally engaging the leads located within said apertures to inhibit separation of the plug portions located in said chamber in use.

Preferably, said cover includes locking means to retain the bodies in the closed position.

Preferably, at least one seal includes a first upper seal portion and a second lower seal portion, the portions being operatively associated with each other to surround a lead located within said associated aperture in use to prevent said lead from moving relative to the body to inhibit the lead from moving within said chamber.

Preferably, at least one said cover body is transparent.

Preferably, at least one said cover body is manufactured of a solid material.

Preferably, said seal is a single unitary seal surrounding a rim of said first body.

Preferably, said seal is a single unitary seal surrounding a rim of said second body.

Preferably, including at least one insert associated with said seal to ensure a waterproof seal of said chamber.

Preferably, including one or more ribs located substantially perpendicular to said longitudinal axis to provide strength to said cover body.

Preferably, including one or more ribs located substantially parallel to said longitudinal axis to provide strength to said cover body.

Preferably, each rim including a groove adapted to receive said seal.

Preferably, including stop means adapted to hold said seal in position.

Preferably, said stop means includes protrusions adjacent said aperture.

BRIEF DESCRIPTION OF DRAWINGS

A preferred form of the present invention will now be described by way of example only with reference to the accompanying drawings wherein.

DESCRIPTION OF EMBODIMENTS

Figure 1:
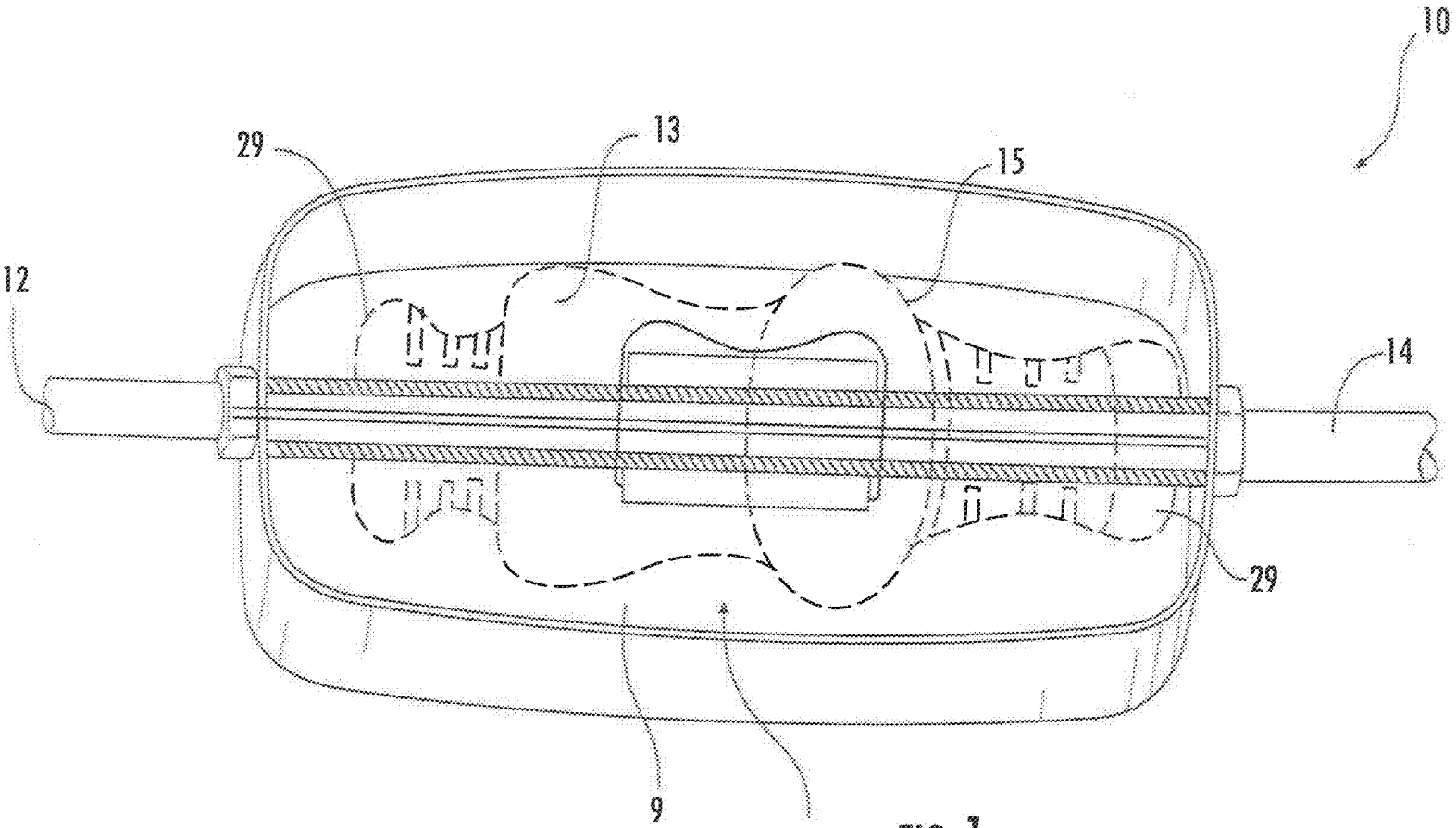
FIG. 1 is a view of a cover of an embodiment of the present invention.
Figure 2:
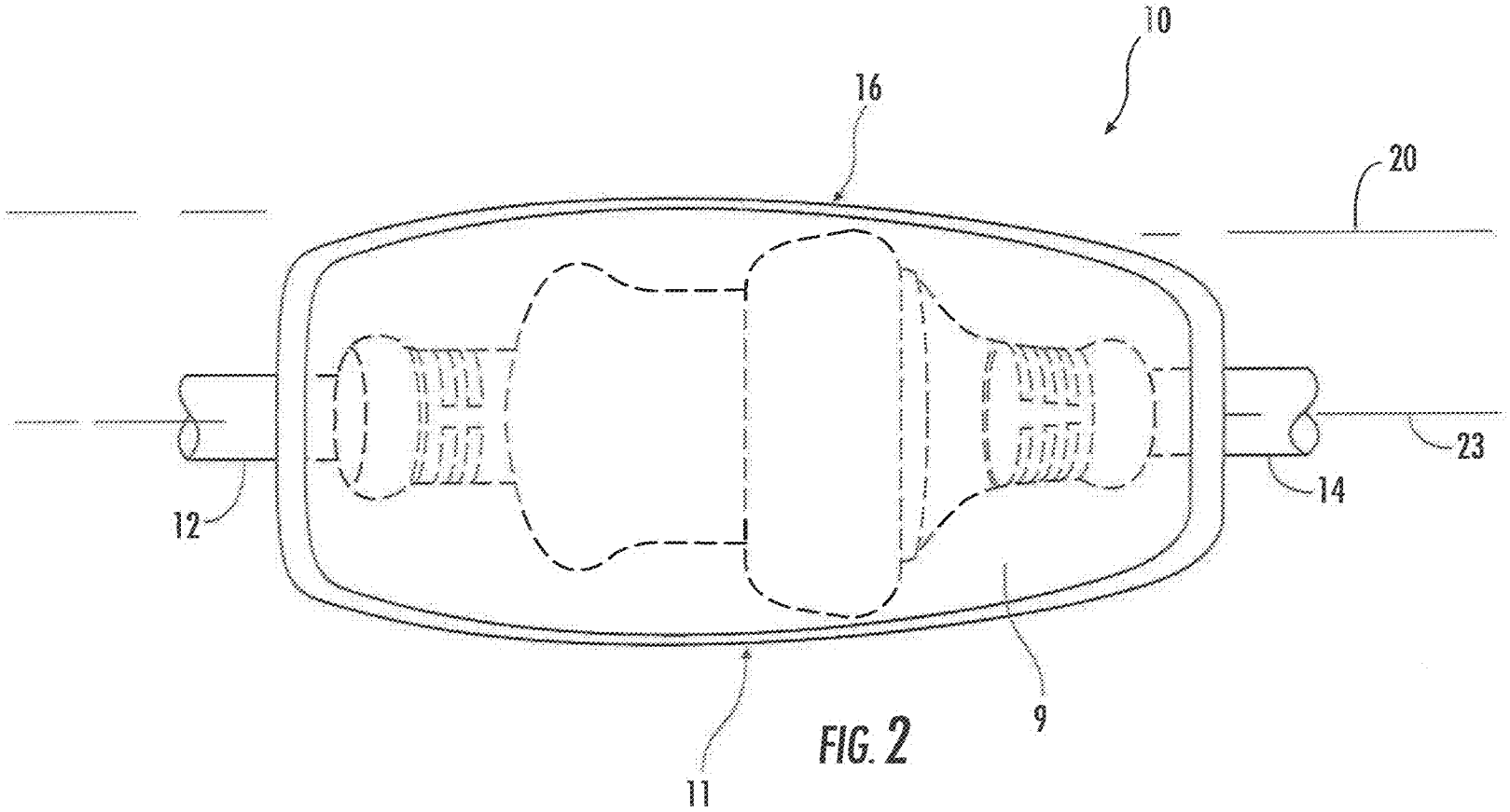
FIG. 2 is a view of a cover of an embodiment of the present invention.
Figure 3:
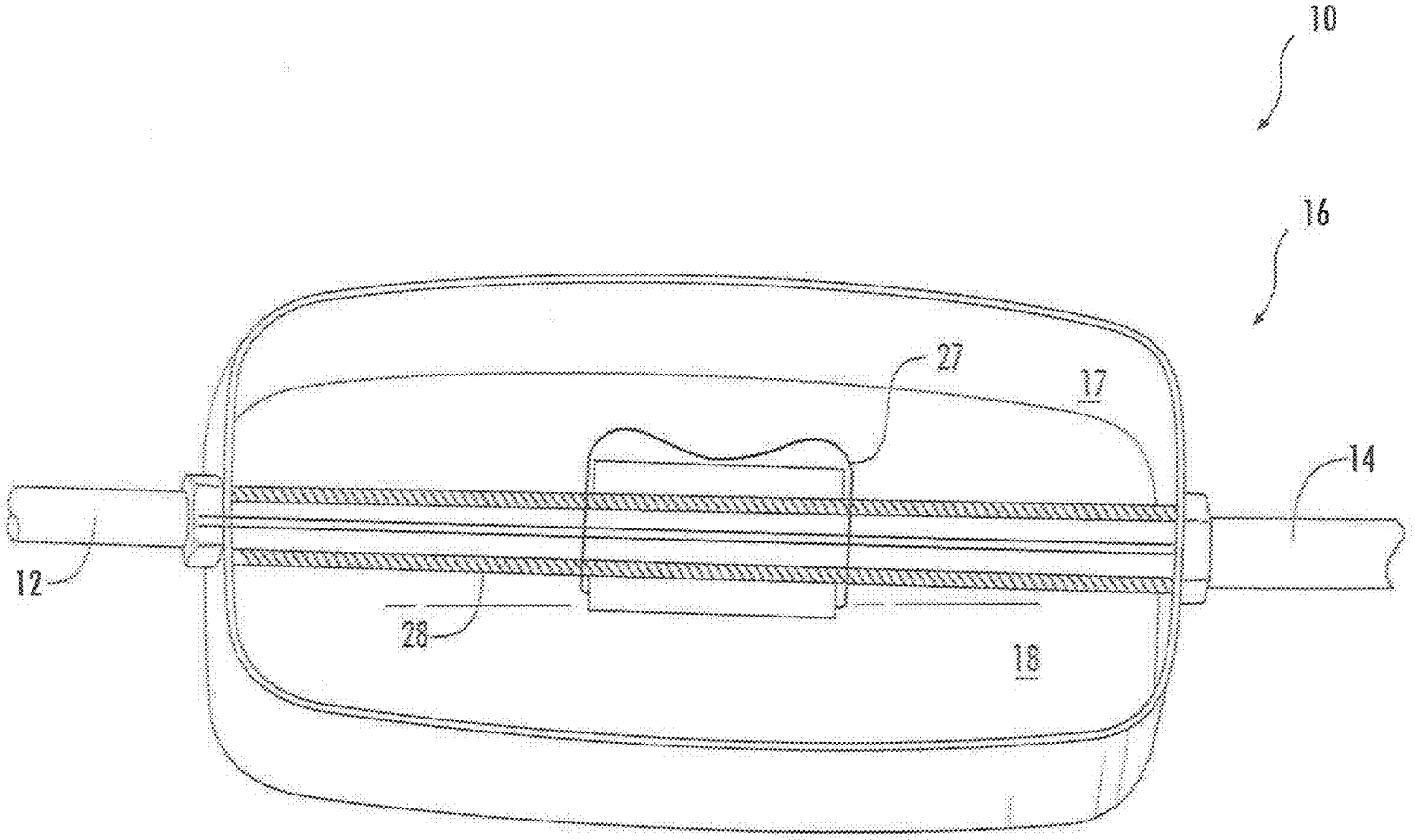
FIG. 3 is a view of a cover of an embodiment of the present invention.
Figure 4:
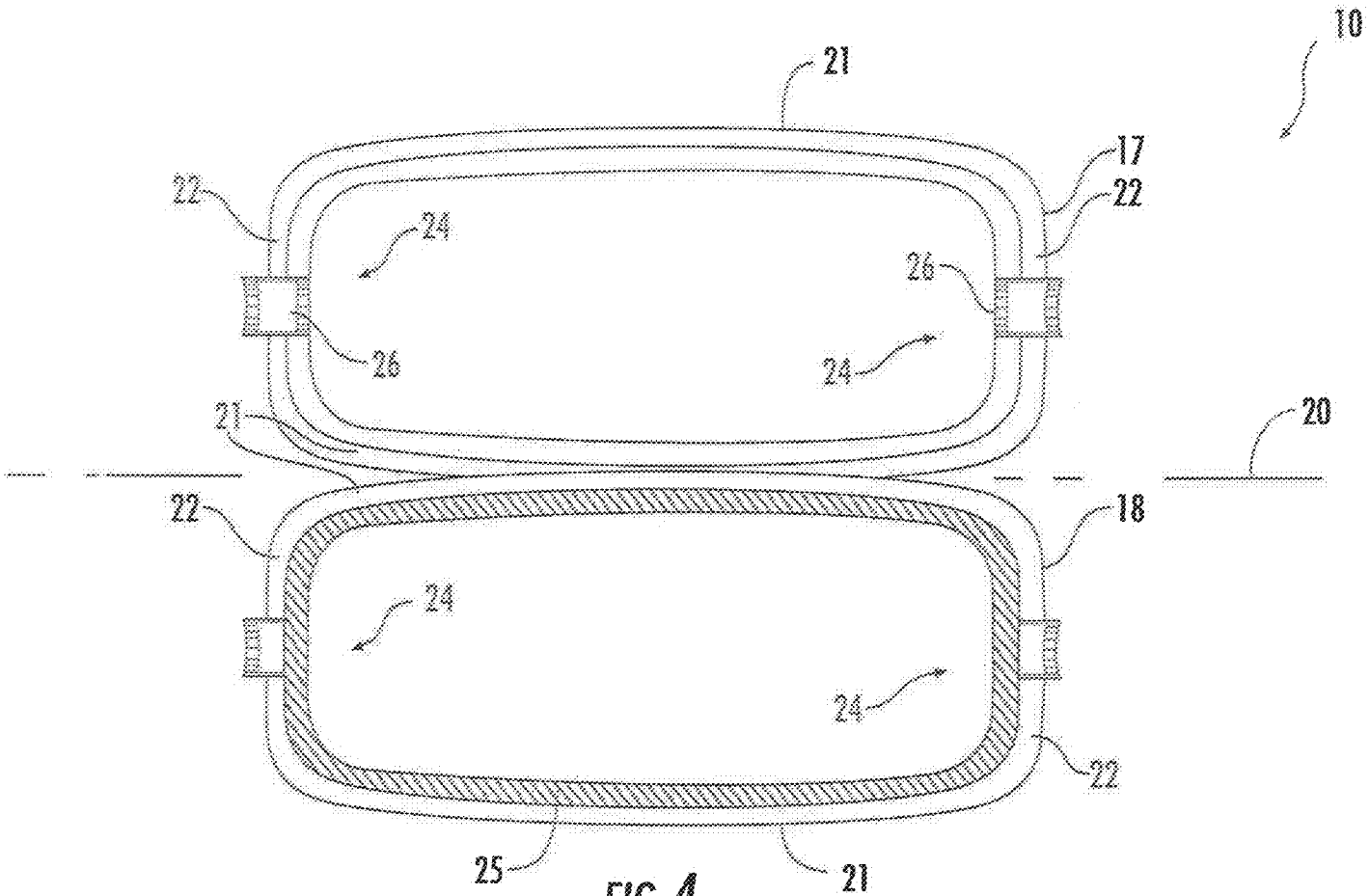
FIG. 4 is a schematic plan view of the cover of FIG. 1 in an open position.
Figure 5:
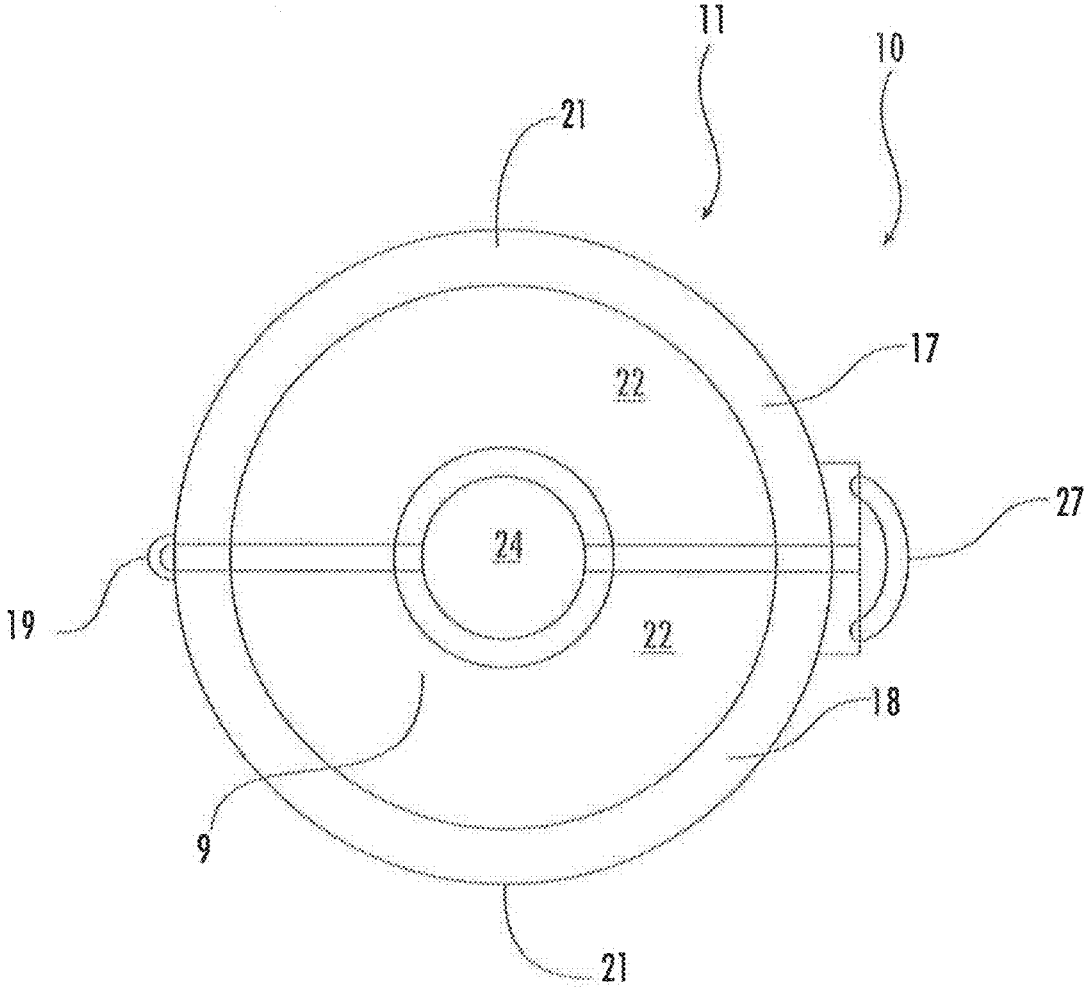
FIG. 5 is an end view of the cover of FIG. 3.
Figure 6:
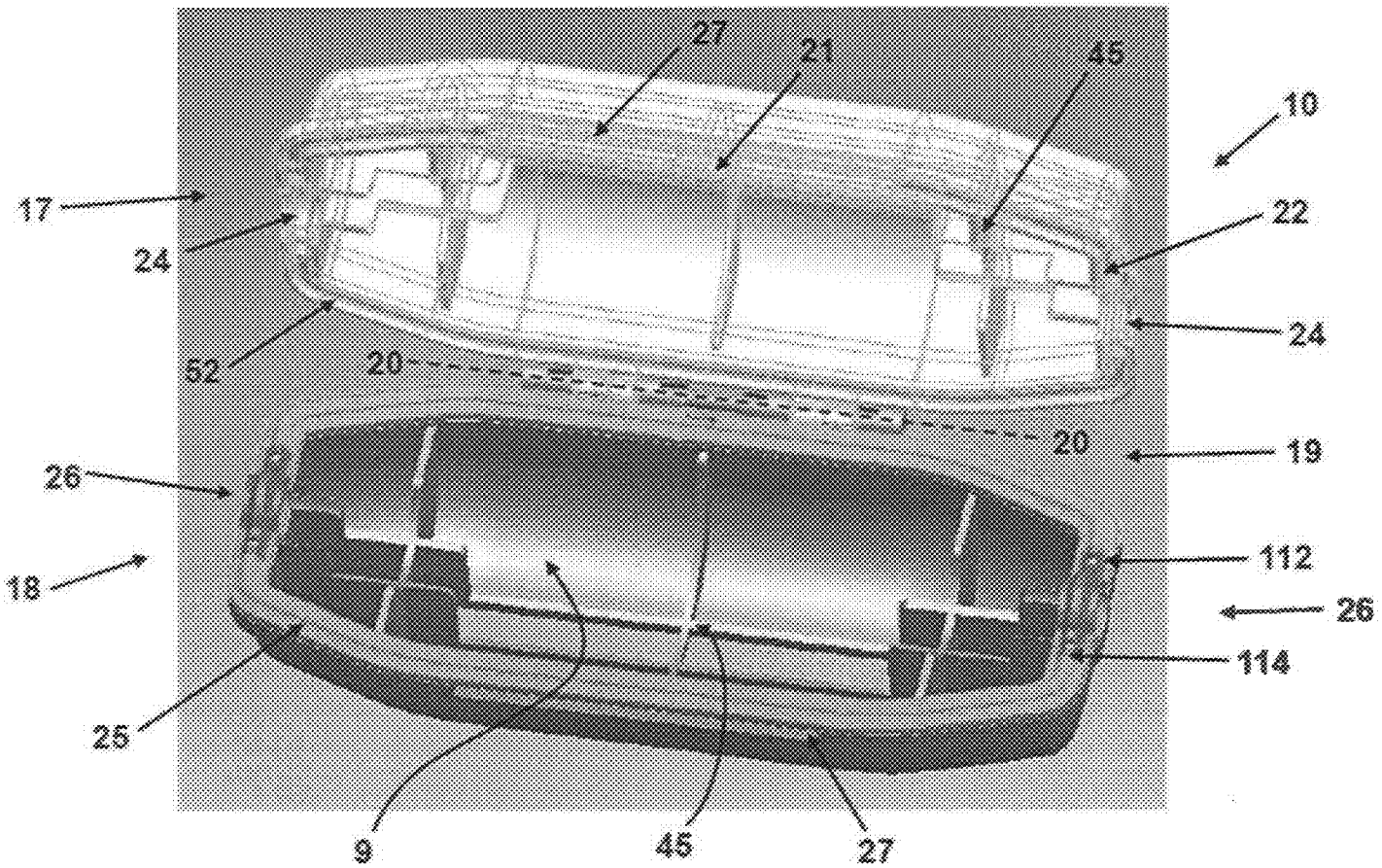
FIG. 6 is an isometric view of an embodiment of the present invention.
Figure 7:
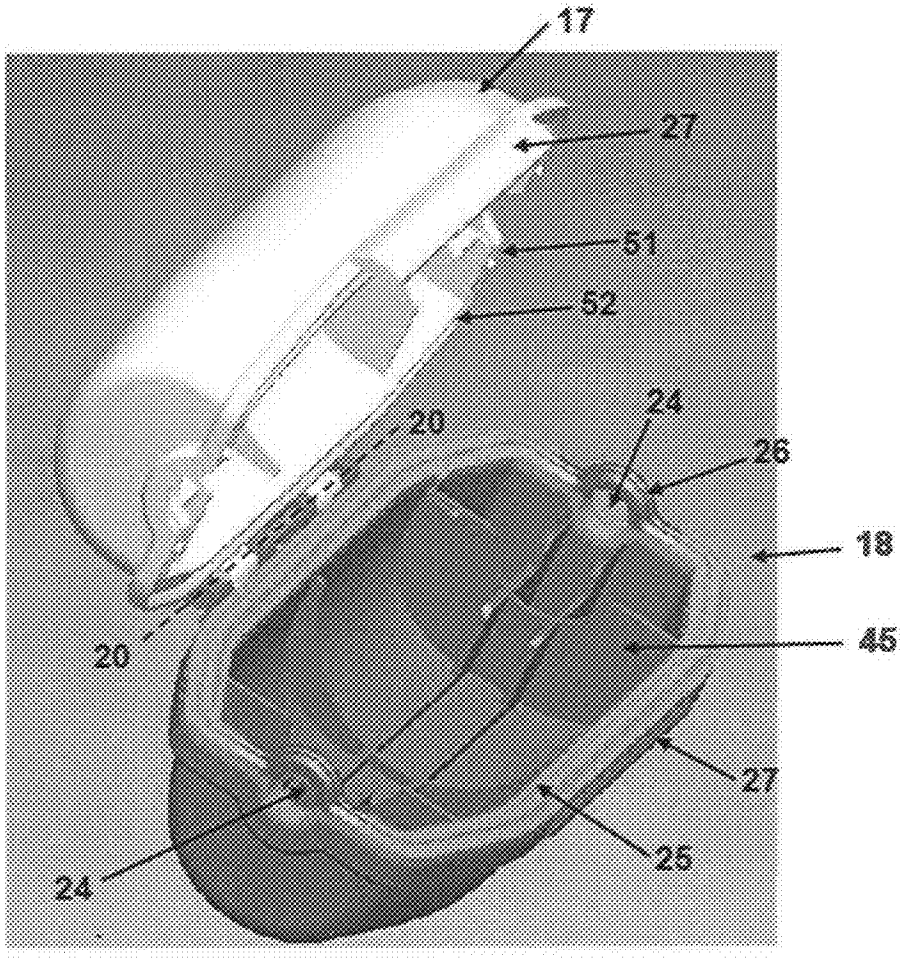
FIG. 7 is a further view of the embodiment of FIG. 6.
Figure 8:
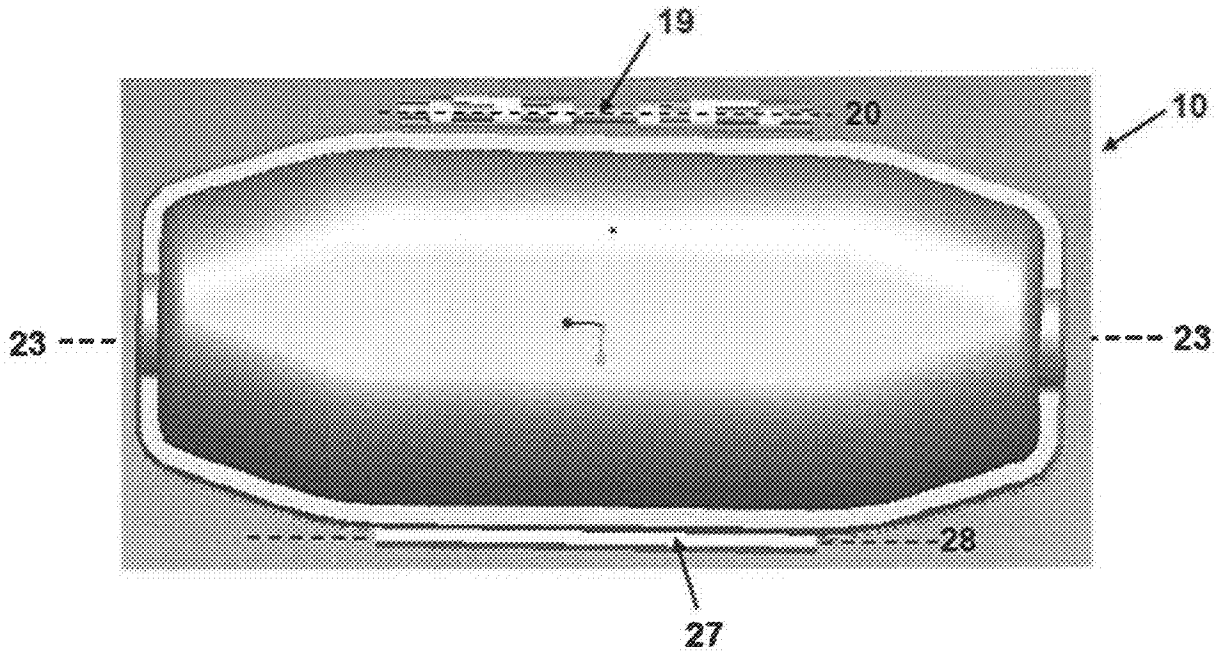
FIG. 8 is a further view of the embodiment of FIG. 6 in a closed configuration.
Figure 9:
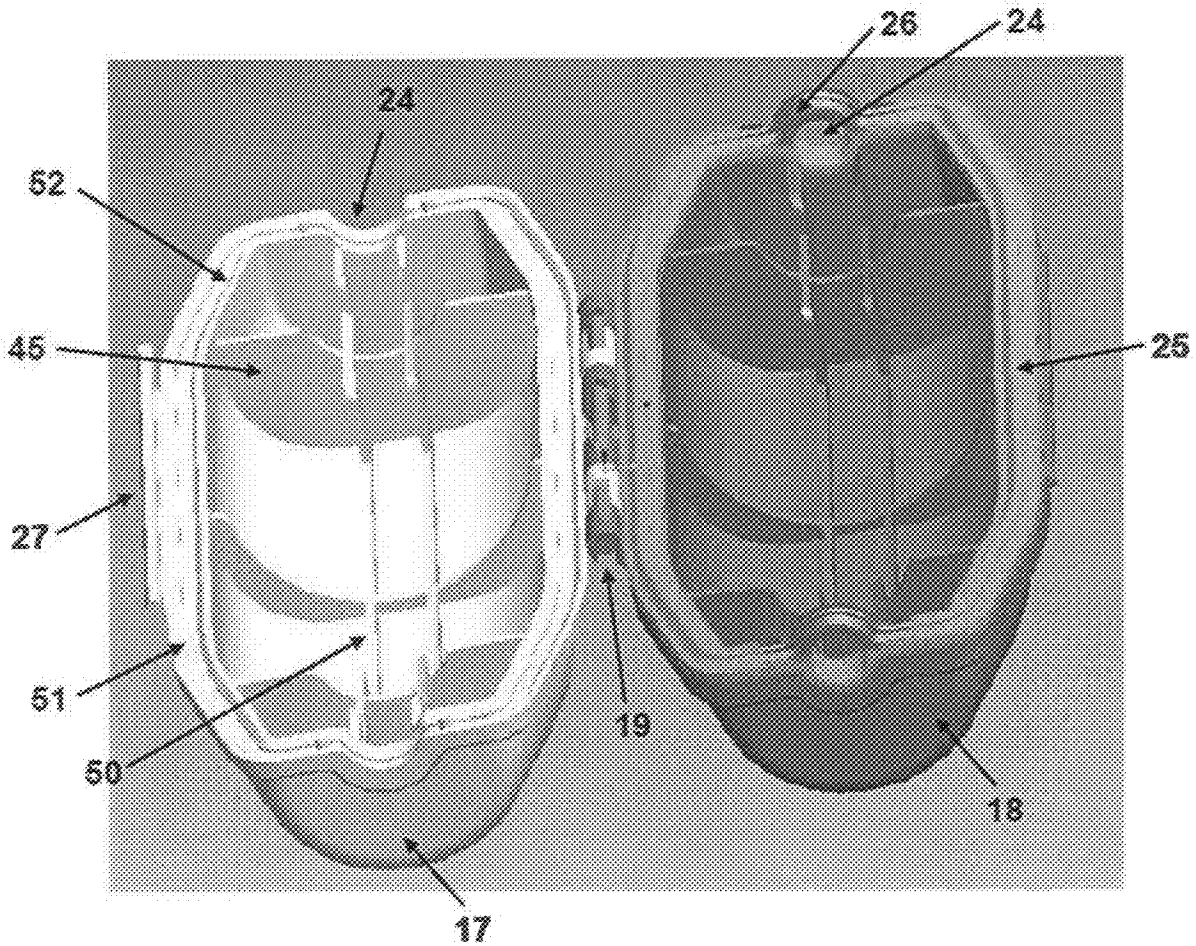
FIG. 9 is a further view of the embodiment of FIG. 6 in an open configuration.

In the accompanying drawings there is schematically depicted a cover 10 to sealingly enclose a plug assembly 11 of an electric lead or the like. The electrical lead includes a plug assembly 11 having a first lead portion 12 extending to a female plug portion 13, and a second lead portion 14 extending to a male plug portion 15. The lead and plug portions 12, 13, 14, 15 forming a plug assembly 11 and are typically electrical leads and plugs.

Figure 10:
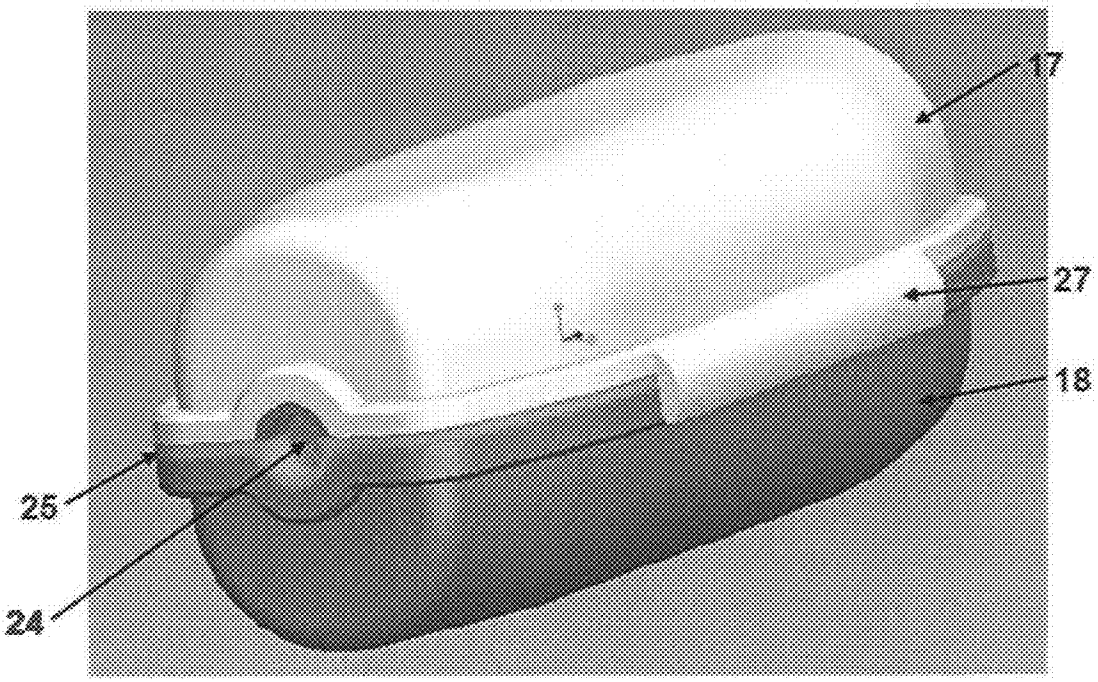
FIG. 10 is a further view of the embodiment of FIG. 6 in a closed configuration.
Figure 11:
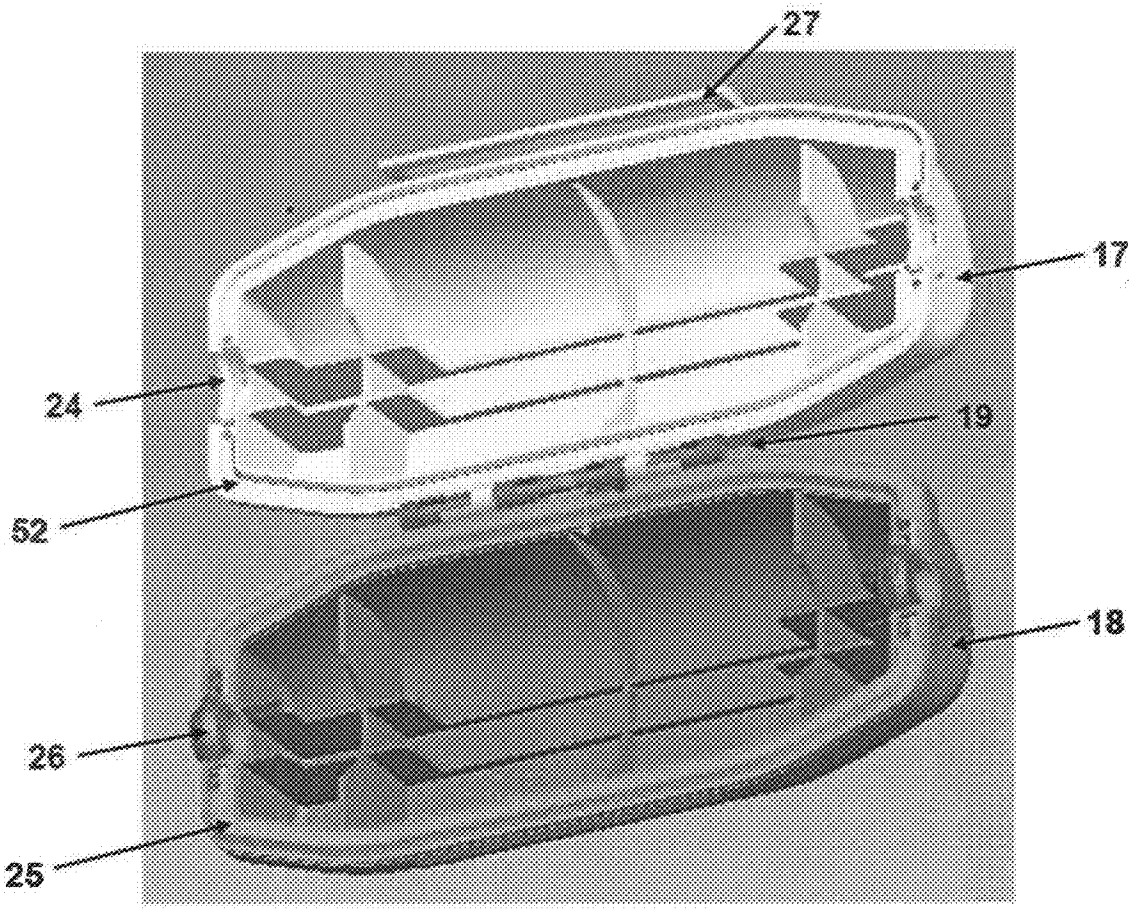
FIG. 11 is further view of the embodiment of FIG. 6 in an open configuration.

The cover 10 includes a hollow body assembly 16 including a first body 17 and a second body 18. The bodies 17 and 18 extending from a base 50 to a rim 51. The rim 51 having a groove 52 or the like being connected by a hinge or hinges 19 so as to be angularly movable relative to each other about an axis 20. The axis 20 being substantially parallel to the longitudinal length of the cover 10 and bodies 17, 18. The bodies 17 and 18 are typically concave in shape so that in the closed position (see FIG. 10) they provide a closed chamber 9 within which the plug assembly 11 is located. In a preferred form, one or more of the bodies 17, 18 are transparent so that a user can see into the closed chamber 9. This will be of assistance as some plugs 13, 14 and the leads 15, 16 include a light or lights (not shown) or other visual indicators to indicate to a user when electricity is flowing through the leads 15, 16. The transparency allows a user to note this light (or visual indication) and that leads 15, 16 are connected. Any separation of the plugs 12, 13 will also be noted. The bodies 17, 18 may also be of different colours and/or different shapes. For example, a rectangular or triangular cross section or the like may be utilised. The bodies 17, 18 when sealed will also provide sufficient floatation so that the cover 10 will float in a liquid while providing a water tight seal to the chamber 9. The cover 10 would be manufactured of a strong solid material, such as hardened plastic or the like, so that a user or object could place weight an the cover 10 inhibiting the cover 10 cracking, breaking or buckling.

Each body 17 and 18 has longitudinally extending side walls 21 and end walls 22. The side walls 21 extend generally parallel to the longitudinal axis 23 of the cover 10. Each of the end walls 22 is provided with a recess or socket 24 providing a space to receive a lead portion 12 and 14. The size and shape of the socket 24 can vary for different regions of the world. The cover 10 will accommodate different electrical standards. One or more ribs 45 can be included in the bodies 17, 18 substantially perpendicular and/or parallel to the longitudinal axis to provide strength to the cover bodies 17, 18.

One of the bodies 17, 18 has seals 25 of resilient material adapted to sealingly engage the other body, while the sockets 24 of the body 17 has seal ends 26 to engage the lead portions 12 and 14. The seals 25, 26 are preferably the one seal and formed of a single unitary piece of resilient material to completely surround the chamber 9 and provide a water tight seal. See for example FIG. 13. The seals 25, 26 have portions, inserts, straps, plugs or the like (see FIG. 13) at each end to fit into the sockets 24. An aperture of various sizes such as 6.5 mm×6.5 mm, 6.5 mm×8.5 mm, 8.5 mm×8.5 mm, 6.5 mm×9.5 mm or 9.5 mm×9.5 mm, for example is formed depending upon lead size.

In the closed position, the bodies 17 and 18 are sealingly connected by the seal 25, with the seal ends 26 sealingly engaging the lead portions 12 and 14 so that the plug assembly 11 is sealingly contained within the cover 10. This arrangement also inhibits the leads 12, 14 from separating apart from each other.

A catch or lock 27 is provided to lock the body 18 to the body 17. The catch 17 in one embodiment is pivotable about an axis 28 that is parallel to the axes 20 and 23. The catch 27 could however be snap locking. A further locking device (not shown) could be utilised to allow the catch 27 to be padlocked closed to prevent the cover 10 from being opened by an unwanted person. the catch 27 can also include a pivotable bar (not shown) to be locked into a hooked protrusion (not shown) on the adjacent body.

Preferably the seal ends 26 frictionally engage the lead portions 12 and 14 to prevent separation of the female plug portion 13 from the male plug portion 15 with the cover 10. In a further embodiment, the end walls 22 are located so as to be adjacent the end extremities 29 to again prevent separation of the female and male plug portions 13, 15.

Figure 12:
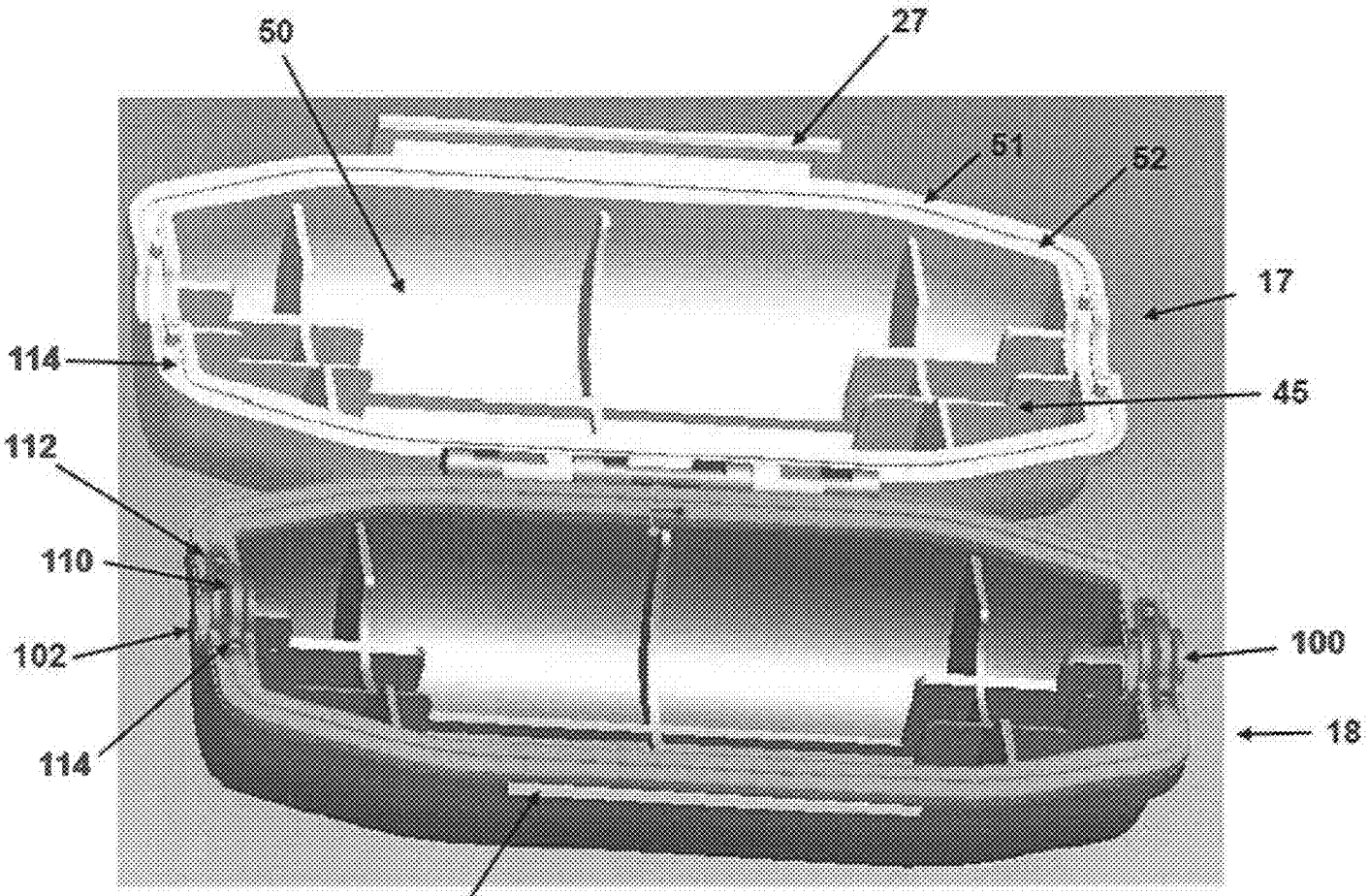
FIG. 12 is further view of the embodiment of FIG. 6 in an open configuration.
Figure 13:
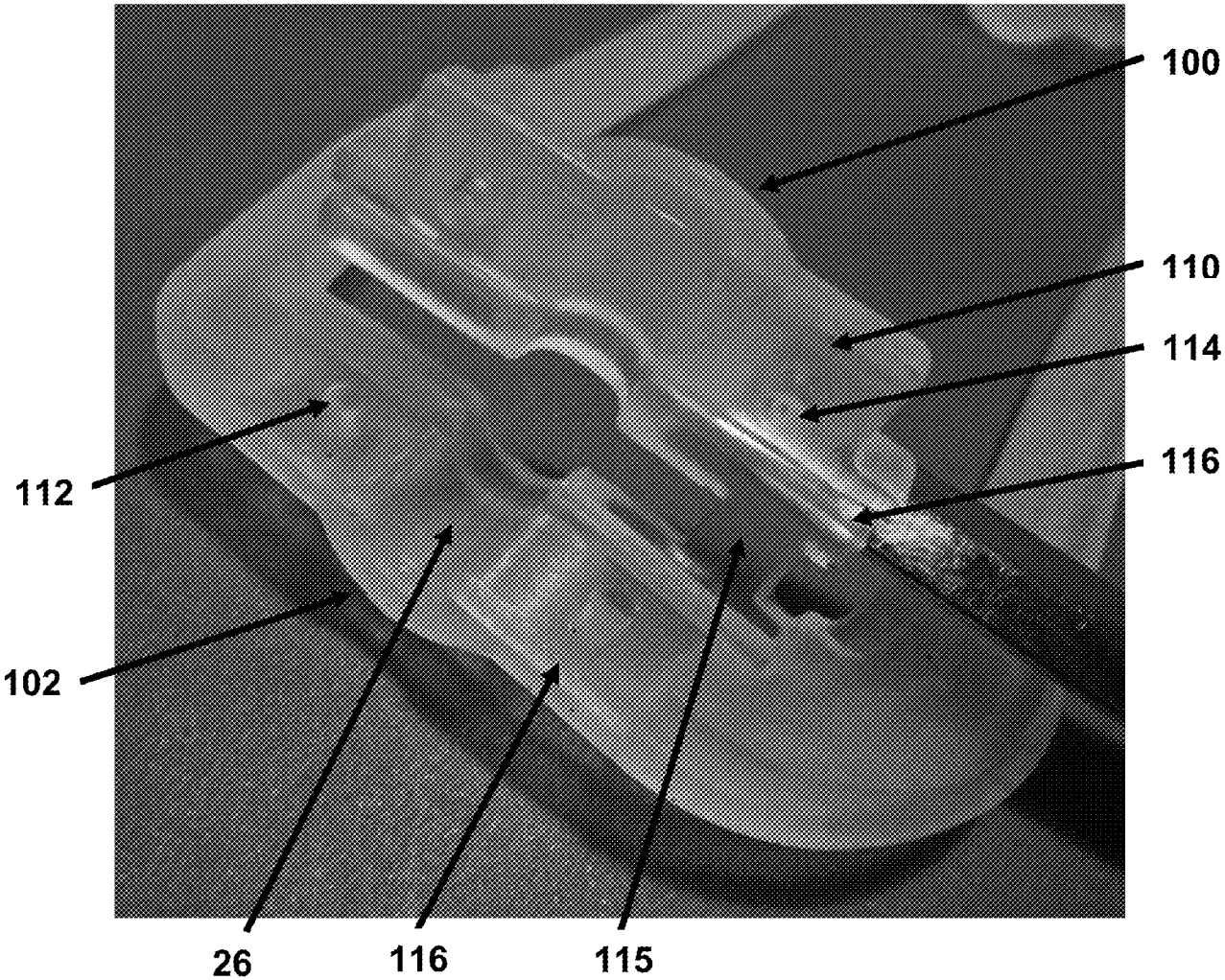
FIG. 13 is a partial end view of a seal of the present invention.

As shown in FIGS. 12 and 13 the seal ends 26 could also include an upper portion 100 and a lower portion 102 which connect together to seal about the lead portions 12 or 14 at one or more end walls 22. The upper portion 100 having a flap 110 with a hole 112 to be received by a corresponding protrusion 114 on the lower portion 102 of the other body or vice versa (as in FIG. 13). The portions 100, 102 can be connected by a hinge 115 or the like and also could include a step and groove 116 to assist fitting and sealing as shown in FIG. 13. This arrangement allows access for the leads 12, 14 and a complete water tight seal of the cover 10. This arrangement will also prevent the leads 12, 14 from moving apart separating the plug assembly 11.

The cover 10 could also include a strap or the like (not shown) to allow the cover 10 to be hung over a surface or the like. A plug (not shown) could also be included within the cover 10 in case there is only one lead.

The cover 10 is adapted to meet standards and watt-amps throughout the world and is adjustable to the local circumstances. Accordingly, in at least a preferred embodiment, a cover 10 for a plug assembly 11 is provided that provides a water tight seal in any environment. Each rim can include one or more grooves or channels to receive said seal.

Although the invention has been described with reference to specific examples, it will be appreciated by those skilled in the art that the invention may be embodied in many other forms.

The invention claimed is:

1. A waterproof cover adapted to enclose a plug assembly of an electrical lead, said cover including:

a first hollow cover body and a second hollow cover body being pivotally attached together for angular relative movement between an open position and a closed position, wherein the first hollow cover body and the second hollow cover body in the closed position provide a chamber to receive the plug assembly and wherein the first hollow cover body and the second hollow cover body define a longitudinal axis and have longitudinally spaced apart oppositely located end walls;

each said end wall having a recess, the recesses of adjacent end walls defining an aperture through which an electrical lead is to extend to an associated male or female plug portion to be located within said chamber in use;

a seal consisting of a one-piece construction seal operatively associated with the first hollow cover body and the second hollow cover body to surround said chamber so that in the closed position the first hollow cover body and the second hollow cover body seal said chamber to provide a water proof seal to said cover, wherein the seal includes a seal end with an upper portion and a lower portion operatively associated with each other for frictionally engaging and surrounding the leads located within said apertures to inhibit separation of the associated male or female plug portion located in said chamber in use.

2. The waterproof cover according to claim 1, wherein said cover includes locking means to retain the bodies in the closed position.

3. The waterproof cover according to claim 1, wherein at least one said cover body is transparent.

4. The waterproof cover according to claim 1, wherein at least one said cover body is manufactured of a solid material.

5. The waterproof cover according to claim 1, said seal surrounding a rim of said first body.

6. The waterproof cover according to claim 1, said seal surrounding a rim of said second body.

7. The waterproof cover according to claim 1, including at least one insert associated with said seal to ensure a waterproof seal of said chamber.

8. The waterproof cover according to claim 1, including one or more ribs located substantially perpendicular to said longitudinal axis to provide strength to said cover body.

9. The waterproof cover according to claim 1, including one or more ribs located substantially parallel to said longitudinal axis to provide strength to said cover body.

10. The waterproof cover according to claim 1, wherein the first hollow cover body, the second hollow cover body, or both include a rim including a groove adapted to receive said seal.

11. The waterproof cover according to claim 1, including stop means adapted to hold said seal in position.

12. The waterproof cover according to claim 11, wherein said stop means includes protrusions adjacent said aperture.

* * * * *